US005669314A

United States Patent [19]

Grant

[11] Patent Number: 5,669,314

[45] Date of Patent: Sep. 23, 1997

[54] MOTORIZED COLLAPSIBLE PLATFORM ASSEMBLY

[76] Inventor: Alvin S. Grant, 6772 Castleton Dr., Clemmons, N.C. 27012

[21] Appl. No.: 566,262

[22] Filed: Dec. 1, 1995

[51] Int. Cl.[6] ..... A47B 5/00

[52] U.S. Cl. ..... 108/48; 108/80; 108/20

[58] Field of Search ..... 108/48, 70, 147, 108/7, 47, 42, 134, 152, 35, 80, 37; 248/35, 4.3

[56] References Cited

U.S. PATENT DOCUMENTS

| | | | |
|---|---|---|---|
| 1,116,091 | 11/1914 | McDonald | 108/134 X |
| 3,288,090 | 11/1966 | King | 108/20 X |
| 4,789,123 | 12/1988 | Mattsson | 108/80 X |
| 4,829,910 | 5/1989 | Lirette | 108/35 |
| 5,259,326 | 11/1993 | Borgman et al. | 108/20 X |

FOREIGN PATENT DOCUMENTS

| | | | |
|---|---|---|---|
| 1540576 | 2/1979 | United Kingdom | 108/48 |

*Primary Examiner*—Jose V. Chen
*Attorney, Agent, or Firm*—Alfred Hoyte, Jr.

[57] ABSTRACT

A motorized collapsible platform assembly which is adapted to be removably attached to a vertical support surface is provided. The assembly has a rotatable platform which may be rotated from a vertical storage position to a horizontal position providing a horizontal work surface. The assembly has a telescoping vertical support member which allows for adjusting the size of the work surface. The vertical support member is connected to a rigid horizontal ledge to which the rotatable platform is hingedly attached. The platform can be remotely rotated by a motor which is attached to the vertical support member and has a drive shaft connected to the underside of the platform.

4 Claims, 2 Drawing Sheets

MOTORIZED COLLAPSIBLE PLATFORM ASSEMBLY

BACKGROUND OF THE INVENTION

1. Field of the Invention

The present invention relates to a collapsible platform assembly and particularly to a motorized collapsible platform assembly.

2. Description of the Prior Art

U.S. Pat. No. 5,101,736 issued to Bommarito et al. discloses an adjustable surface desk for computers. The desk has two centrally located motorized platforms which are normally horizontal. The tilt of the platforms can be independently adjusted to the desired position. By contrast, the present invention contemplates a motorized platform which is normally vertical and can be attached to any vertical surface. In the vertical position the platform assembly allows for a considerable space savings over conventional motorized platforms.

Japanese Pat. No. 4-187104 issued to Kaneda discloses a collapsible platform assembly which has a platform movable between a collapsed, vertical position and a horizontal work position. The platform is mounted to a vertical member which extends from a relatively large base having casters. By contrast, the present invention is wall mounted to achieve maximum space savings when in the vertical storage position.

U.S. Pat. No. 4,440,096 issued to Rice et al. shows an adjustable word processing table having a split top. The top is supported by a relatively massive support assembly which allows for independent motorized movement of the top surfaces. By contrast, the present invention contemplates a motorized platform assembly having no base and being removably secured to a vertical support surface.

Italian Pat. No. 647,229 shows a desk having a motorized top which is movable to a desired angle by the user. By contrast, the present invention is a portable motorized platform assembly which can be wall mounted in any room having an electrical outlet.

As will be seen, the simplicity and effectiveness of my invention is not rivaled in the prior art.

It will be noted that all the prior art devices suffer from the drawback in that they are either relatively complex or require a large number of interchangeable parts.

None of the above inventions and patents, taken either singly or in combination, is seen to describe the instant invention as claimed.

SUMMARY OF THE INVENTION

Briefly, the invention comprises a motorized collapsible platform assembly which is adapted to be removably attached to a vertical support surface. The assembly has a rotatable platform which may be rotated from a vertical storage position to a horizontal position providing a horizontal work surface. The assembly has a telescoping vertical support member which allows for adjusting the height of the work surface. The vertical support member is connected to a rigid horizontal ledge to which the rotatable platform is hingedly attached. The platform can be remotely rotated by a motor which is attached to the vertical support member and has a drive shaft connected to the underside of the platform.

Accordingly, it is a principal object of the invention to provide a new and improved motorized collapsible platform assembly which overcomes the disadvantages of the prior art in a simple but effective manner.

It is a major object of this invention to provide a new and improved motorized collapsible platform assembly which has a platform which can be rotated between a vertical storage position and a horizontal position.

It is another object of the invention to provide such an improved assembly which can be remotely actuated.

It is another object of the invention to provide a motorized collapsible platform assembly which is portable and can be attached to any vertical support surface.

Finally, it is a general object of the invention to provide improved elements and arrangements thereof in an apparatus for the purpose described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
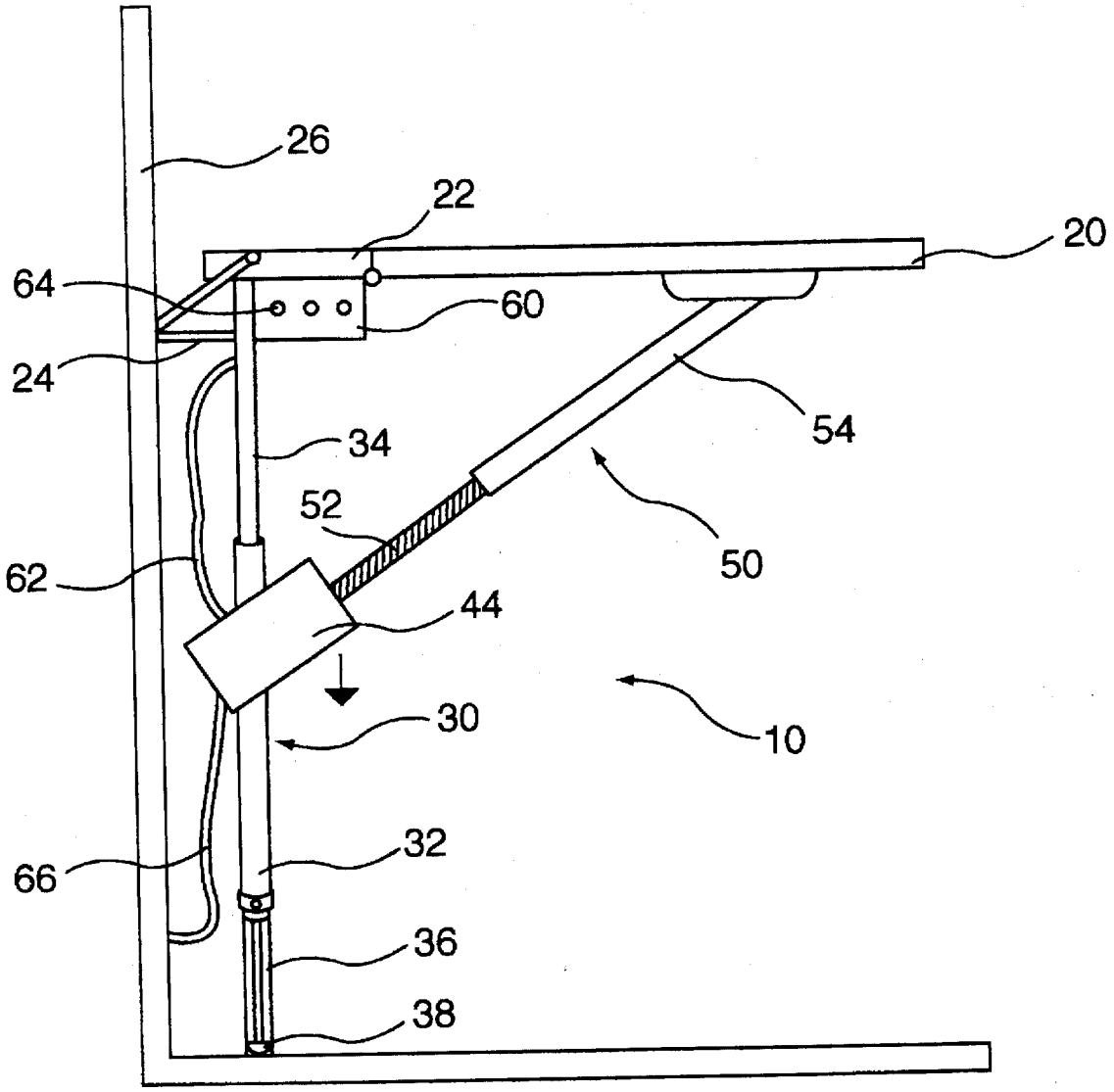
FIG. 1 is a side view of the motorized platform assembly of the present invention showing the platform in the horizontal work position.

Referring now to FIG. 1 a side view of the present invention generally designated by the number 10 is shown. A platform or work surface 20 is hingedly attached to a support ledge 22 which is attached by screws 24 or other suitable fastening means to a wall 26 or other vertical support surface.

The ledge 22 is connected to a vertical support member 30. The support member 30 is telescoping and has an outer member 32 and an inner member 34. The telescoping support member 30 allows for longer travel of the motor screw drive as will be explained later. A cylindrical base 36 extends from the end of the outer member 32 and may have a rubber tip 38 to help secure the assembly 10 from slippage.

Figure 2:
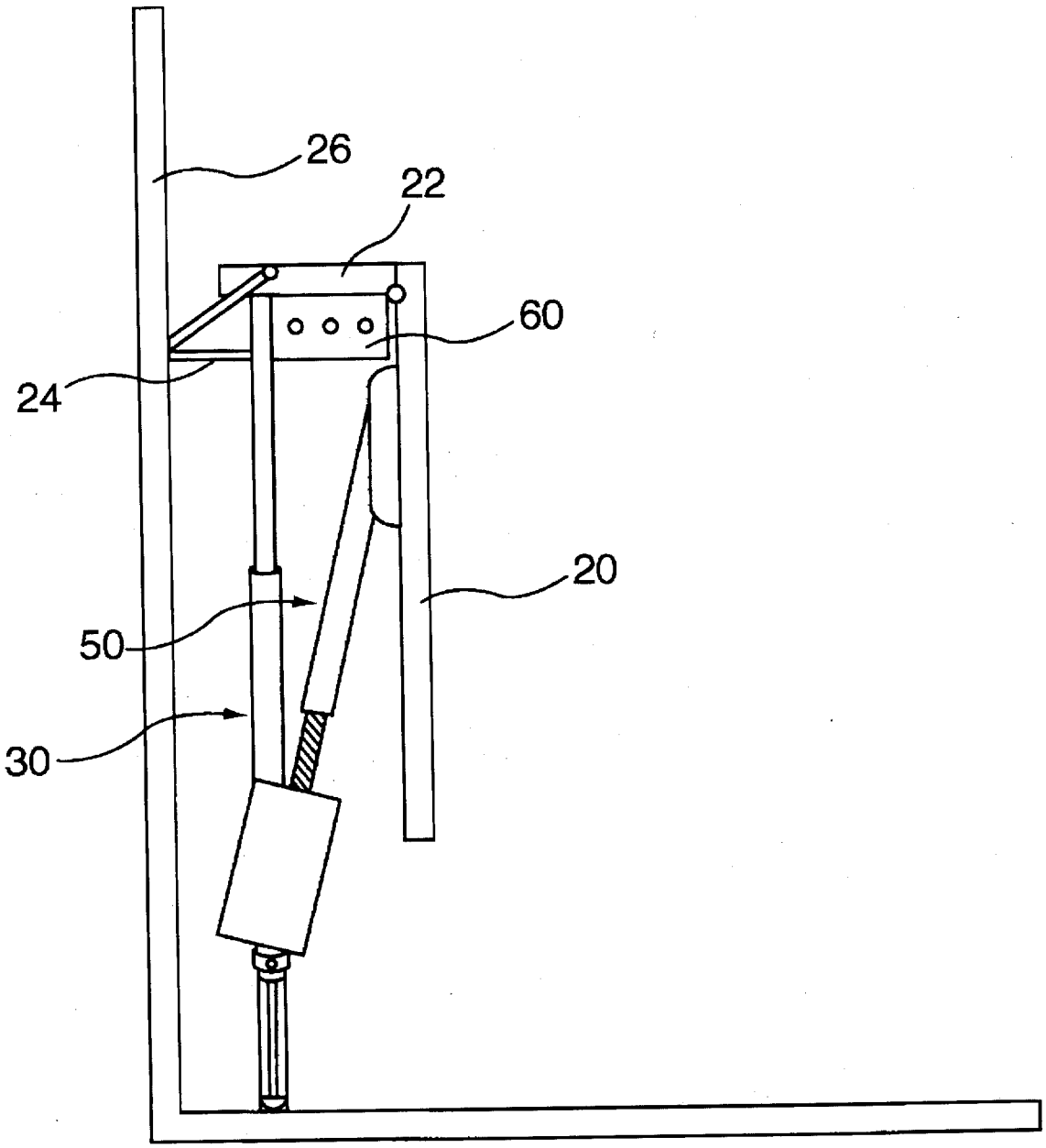
FIG. 2 is a side view of the assembly of FIG. 1 in the vertical storage position.

A motor 44 is fastened to the support member 30 by a clamp (not shown) or other suitable fastening means. A drive shaft arrangement 50 is connected to and extends from the motor 44. The drive shaft arrangement 50 consists of a screw drive 52 which is connected to the motor 44 at one end and is threadably engaged with an internally threaded cylinder 54 at the other end. The cylinder 54 is attached to the underside of the work surface. Thus, turning of the screw drive 52 by the motor 44 causes movement of the work surface between the vertical storage position as shown in FIG. 2 and the horizontal position shown in FIG. 1. If a longer travel of the screw drive 52 is needed, it can be accommodated by telescoping outer member 32 which can be vertically displaced relative to member 34.

Power to the motor 44 is selectively applied by the control unit 60. The control unit 60 is electrically connected to the motor 44 by cables 62. A plurality of switches 64 are used to supply the desired control signal to the motor. In a preferred embodiment, the control unit 60 also includes an infrared window (not shown) or other means for allowing reception of a control signal from a remote controller. Power to the control unit 60 and motor 44 are supplied via power cord 66 which is plugged into a wall outlet. In an alternative embodiment, the control unit 60 and the motor 44 are plugged into a switched wall outlet so that the work surface 20 is automatically raised/lowered in accordance with the position of the wall switch.

In operation, when not in use, the work surface 20 is in the vertical storage position as seen in FIG. 2. When it is desired to raise the work surface 20 to a working position, the control unit 60 is activated by the remote controller, a wall switch, or the control switches 64. Activation of the control unit 60 causes rotation of screw drive 52 which in turn causes rotation of the work surface 20 until it is either horizontal or at a desired angle of tilt. If desired, the entire assembly 10 can be released from the wall 26 by loosening screws 24. The assembly 10 can then be reattached to another vertical support surface. The entire assembly 10 is relatively lightweight and therefore reasonably portable.

If desired, the work surface 20 can be replaced by a work surface 20 having different dimensions. Of course, the length and angle of the screw drive 52 may have to be adjusted in order to properly raise and lower to the work surface 20.

It is to be understood that the provided illustrative examples are by no means exhaustive of the many possible uses for my invention.

From the foregoing description, one skilled in the art can easily ascertain the essential characteristics of this invention and, without departing from the spirit and scope thereof, can make various changes and modifications of the invention to adapt it to various usages and conditions.

It is to be understood that the present invention is not limited to the sole embodiment described above, but encompasses any and all embodiments within the scope of the following claims:

I claim:

1. A collapsible platform assembly adapted to be secured to a vertically extending surface such as a wall and having a planar work surface which is adjustable between a horizontal work position and a vertical storage position comprising:

a single vertical support member having an upper end and a lower end, said lower end having a cylindrical coaxial base member extending therefrom, said base member attached to an inner coaxial member, said vertical support member further including an outer coaxial member axially slidable upon said inner member, said outer coaxial member having an outer surface and an inner surface, said upper end of said vertical support member having a horizontal support ledge attached thereto, said horizontal support ledge being attached to said wall at one side and being hingedly connected to said planar work surface at an opposing side, a source of motive power attached to said outer surface of said outer coaxial member, said source of motive power being operably connected to a first end of an axially reciprocable drive shaft, the drive shaft having an opposing end connected to said work surface thereby allowing adjustment of the position of said work surface in accordance with the actuation of said source of motive power.

2. The device of claim 1 where said source of motive power is a remotely controllable electric motor.

3. The device of claim 1 where said source of motive power is actuated by a wall switch.

4. The device of claim 1 including a plurality of work surfaces of varying dimensions attachable to said support ledge.

* * * * *